United States Patent [19]

Handmer

[11] Patent Number: 5,005,506

[45] Date of Patent: Apr. 9, 1991

[54] RECREATIONAL WATER VEHICLE

[75] Inventor: Charles Handmer, Killarney Heights, Australia

[73] Assignee: Powerboard Australia Pty Limited, Australia

[21] Appl. No.: 378,573

[22] PCT Filed: Oct. 23, 1987

[86] PCT No.: PCT/AU87/00359

§ 371 Date: Jun. 19, 1989

§ 102(e) Date: Jun. 19, 1989

[87] PCT Pub. No.: WO88/03109

PCT Pub. Date: May 5, 1988

[30] Foreign Application Priority Data

Oct. 23, 1986 [AU] Australia ..... PH8651

[51] Int. Cl.[5] ..... B63B 35/72

[52] U.S. Cl. ..... 114/270; 441/74

[58] Field of Search ..... 114/270, 61; 440/88, 440/89, 38, 43; 441/74

[56] References Cited

U.S. PATENT DOCUMENTS 3,433,201 3/1969 Brown et al. ..... 114/270

4,274,357 6/1981 Dawson ..... 114/270

FOREIGN PATENT DOCUMENTS 1371864 8/1964 France ..... 114/61

*Primary Examiner*—Jesus D. Sotelo

*Attorney, Agent, or Firm*—Christie, Parker & Hale

[57] ABSTRACT

A recreational water vehicle contoured to suit an occupant in a seated position with legs outstretched. An upwardly extending engine housing at the rear of the vehicle also serve as a backrest for the seated driver and laterally extending portions at opposite sides at the rear of the vehicle assist low speed turning which is achieved by driver body lean which at least, in part, submerges the laterally extending portion on one side to create drag on that side and turn the vehicle to that side.

6 Claims, 2 Drawing Sheets

RECREATIONAL WATER VEHICLE

This invention relates to recreational water vehicles. Recreational water vehicles have taken many forms including those which may be generally described as water scooters. These include vehicles which are capable of conveying a person, resemble water born motor scooters on which the pilot sits astride and operates with handle-bars, and jet ski arrangements on which the driver stands.

Generally these vehicles require steering arrangements which naturally add to the cost and complexity of the vehicle. Directional control of some of those vehicles is achieved by body lean; or by the driver creating differential drag by placing a hand or leg in the water in order to turn the vehicle. Vehicles of the general type with which the present invention is concerned are disclosed in AU-B 23826/62; AU-B 51972/64; AU-A 34321/68; AU-B 66456/81; AU-B 76677/81; AU-A 90525/82; DE-A 3503046; FR-A 351515138 and US 3324822.

In the case where steering is achieved by body lean the known vehicles lack response and maneuverability, particularly at low speed. The present invention aims to provide a recreational water vehicle in which steering is initiated by body lean but in which the vehicle, by virtue of its design, facilitates enhanced maneuverability, particularly at low speed where the turning circle and rate of turn are poor in existing craft of this general type.

Another failing of existing vehicles of this type is their lack of resistance to inversion which could disable the craft through ingestion of water by the motor.

In a second aspect the invention aims to provide a recreational water vehicle in which flotation is provided to resist inversion of the motor.

The present invention provides a recreational water vehicle, which comprises:

a longitudinally extending hull;

an engine housing attached to a rear of the hull and having means for non-steerably mounting a motor so that propulsion of the vehicle is always directly forward; the housing extending upwardly from the hull so as to provide a backrest for a seated driver; and handle means mounted on the hull to enable the driver to keep a hold on the vehicle;

the vehicle being steerable by weight transfer of the driver from side to side of the vehicle; and wherein a laterally extending portion is provided at each side adjacent the rear of the vehicle to assist slow speed turning of the vehicle.

In a further form the present invention provides a recreational water vehicle, which comprises:

a longitudinally extending hull;

an engine housing attached to a rear of the hull and having means for non-steerably mounting a motor so that propulsion of the vehicle is always directly forward;

the housing extending upwardly from the hull so as to provide a backrest for a seated driver; and handle means mounted on the hull to enable the driver to keep a hold on the vehicle;

the vehicle being steerable by weight transfer of the driver from side to side of the vehicle; and wherein the housing for the engine contains flotation means at an upper end thereof so that in the event of the vehicle tipping over the flotation means resists inversion and submersion of the motor and hence the vehicle when fitted to the vehicle. The flotation means are generally spaces filled with a foam plastics material or air.

In a further embodiment the hull is provided with footrests to facilitate placement of the drivers feet and to further assist in the control of the vehicle.

In a particularly preferred form the water vehicle incorporates a conventional outboard motor within the engine housing with the leg of the motor extending downwardly with the propeller of the motor at the required depth below the underside of the hull of the vehicle for efficient operation. It is understood that small watercraft powered by outboard motors are relatively unstable due to the high centre of gravity of the motor. It is noted that prior art vehicles of this type have employed motors which are integrated into the hull so as to be much lower and hence reduce the unbalancing effect or transverse stability of the vehicle.

By employing buoyancy means at or near the upper limits of the engine housing or cowling an outboard motor when fitted to the vehicle is substantially protected from inversion and hence ingestion of water by reason of those buoyant means. Without inversion protection for a conventional outboard motor fitted to the vehicle there would be considerable inconvenience and cost associated with servicing of the motor due to the ingestion of water.

One preferred embodiment of the present invention will now be described by way of example only, with reference to the accompanying drawings, in which.

Figure 1:
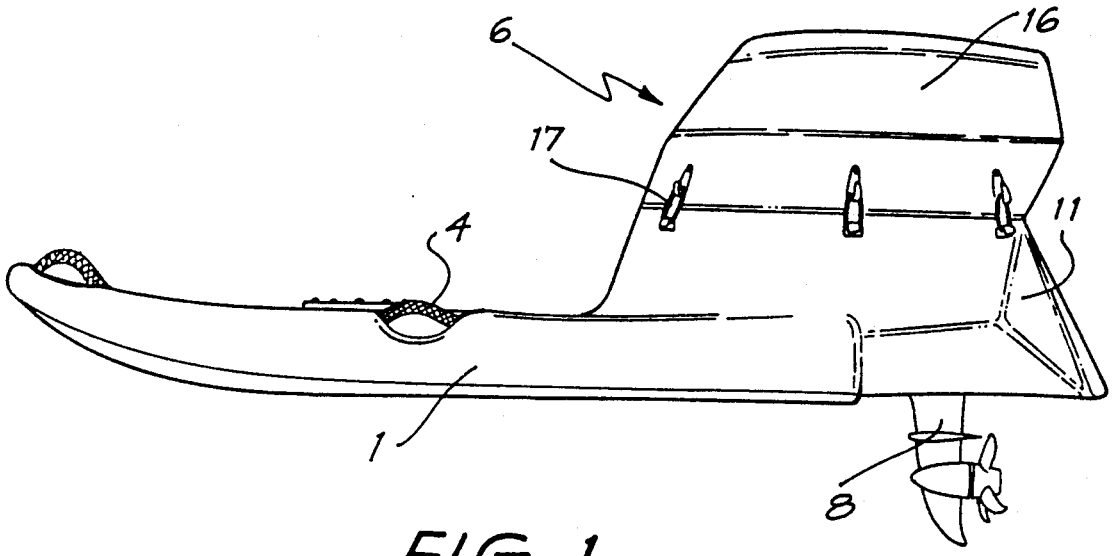
FIG. 1 is a side elevation of a recreational water vehicle according to the present invention.
Figure 2:
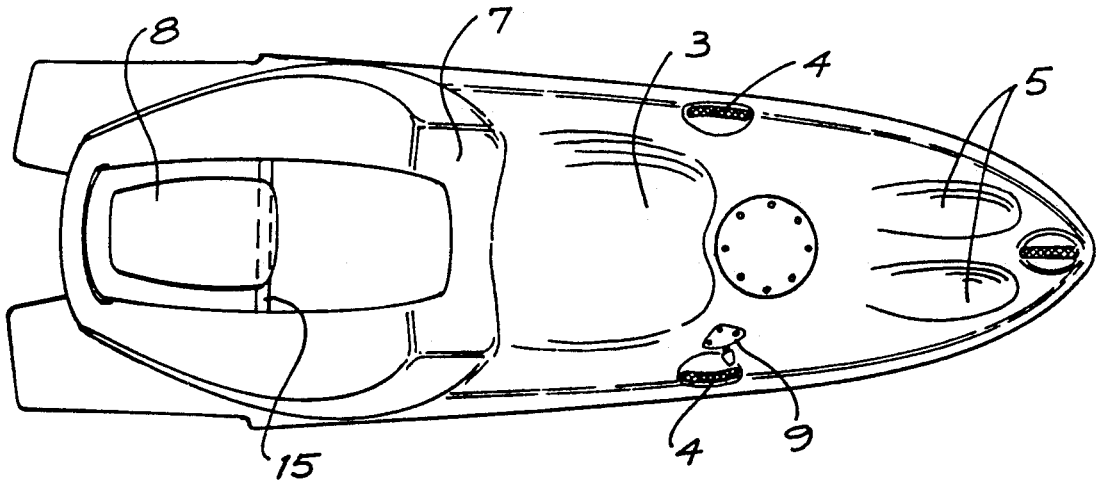
FIG. 2 is a plan view of the vehicle of FIG. 1.
Figure 3:
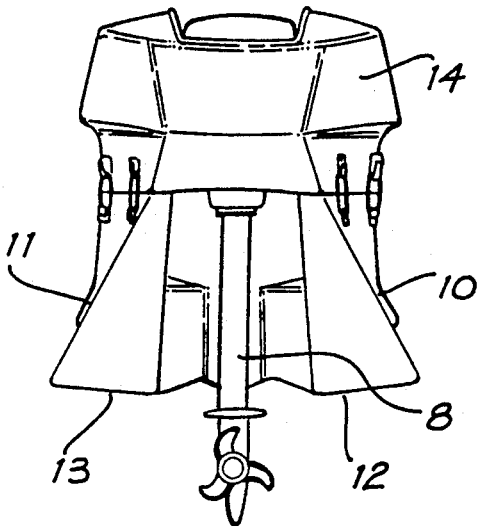
FIG. 3 is a rear-end view of the same vehicle.
Figure 4:
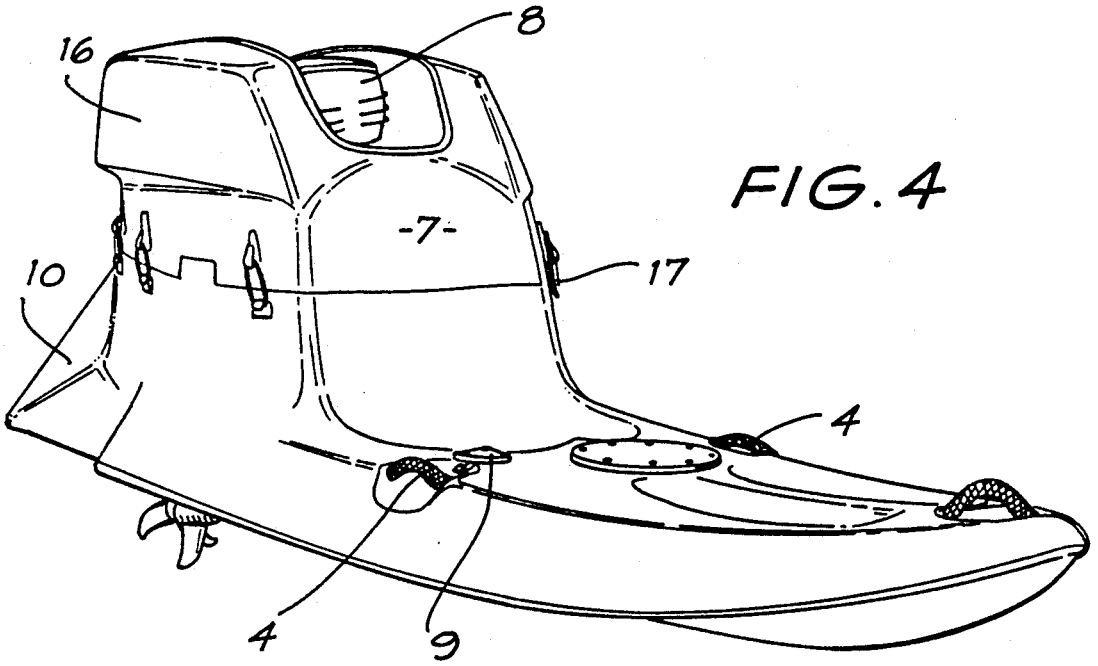
FIG. 4 is a perspective view of the vehicle of FIG. 1.

The recreational water vehicle shown in the drawings comprises a hull 1 having a rearward portion. The hull comprises a moulded seat 3. A pair of handles 4, are provided on the hull to allow the seated pilot to grip the sides of the hull and operate hand throttle 9. Also provided are footrest indentations 5 in the hull. The hull 1 is of hollow construction and is partially filled with a buoyant foam.

An engine housing 6 is attached to the rear of the hull and forms a backrest 7 co-operating with the seat portion 3 to provide a seating arrangement for a driver. Within the housing 6 is an outboard motor 8 fixed to a transom 15. The housing has a removable top cowling portion 16 secured by clips 17.

The sides of the housing are provided with lateral scooped portions 10, 11 which deflect the water sideways when the rear of the vehicle sits lower in the water at lower speeds. When the driver shifts his bodyweight to one side this causes one scooped portion to be submerged whilst the opposite scooped portion rises out of the water, thereby helping the boat turn more quickly at slower speeds. In straight line motion of the vehicle the portions 10, 11 are substantially above the water level and hence provide minimal resistance whereas they are particularly effective for slow speed turning.

The underneath side of the hull 1 has two slightly concave surfaces 12 and 13 which provide a good planing surface and cause spray generated by the motion of the vehicle to be kept underneath.

The housing 6 includes flotation tanks 14 in the sides thereof to assist in general buoyancy and in particular to keep the engine above the water should the vehicle roll over.

I claim:

1. A recreational water vehicle, which comprises:

a longitudinally extending hull;

an engine housing attached to a rear of the hull and having means for non-steerably mounting a motor so that propulsion of the vehicle is always directly forward; the housing extending upwardly from the hull so as to provide a backrest for a seated driver; and handle means mounted on the hull to enable the driver to keep a hold on the vehicle;

the vehicle being steerable by weight transfer of the driver from side to side of the vehicle; and wherein a laterally extending portion is provided at each side adjacent the rear of the vehicle to increase drag on one side upon leaning of the vehicle so as to assist slow speed turning of the vehicle, each laterally extending portion being substantially within the perimeter of a plan view of the hull and scooped inwardly of each respective side of the vehicle.

2. A recreational water vehicle as claimed in claim 1 further comprising flotation means at an upper end of the housing, said flotation means acting to resist inversion and submersion of the engine housing of the vehicle.

3. A vehicle as claimed in claim 1 or 2 wherein said handle means comprises hand holds on opposite sides of the hull with a hand operated throttle positioned adjacent one hand hold for operation by one hand of the driver while gripping said hand hold.

4. A recreational water vehicle, which comprises:

a longitudinally extending hull;

an engine housing attached to a rear of the hull and having means for non-steerably mounting a motor so that propulsion of the vehicle is always directly forward;

the housing extending upwardly from the hull so as to provide a backrest for a seated driver; and handle mans mounted on the hull to enable the driver to keep hold on the vehicle:

the vehicle being steerable by weight transfer of the driver from side to side of the vehicle; and comprising a laterally extending portion at each side adjacent the rear of the vehicle to increase drag on one side upon leaning of the vehicle to assist slow speed turning of the vehicle; and wherein the engine housing contains flotation means comprising buoyant foam filled compartments at an upper end thereof so that in the event of the vehicle tending to tip over the flotation means resists inversion and submersion of the engine housing.

5. A vehicle as claimed in claim 4 wherein the engine housing comprises an upper cowling removably secured to a lower part of the housing.

6. A vehicle as claimed in claim 1 or 4 adapted to be fitted with an outboard motor.

* * * * *